United States Patent [19]

Arkans

[11] 4,437,408

[45] Mar. 20, 1984

[54] DEVICE FOR APPLYING INDICIA TO AN ELASTIC WEB

[75] Inventor: Edward J. Arkans, Schaumburg, Ill.

[73] Assignee: The Kendall Company, Boston, Mass.

[21] Appl. No.: 159,707

[22] Filed: Jun. 16, 1980

[51] Int. Cl.[3] ..... B41C 1/02

[52] U.S. Cl. ..... 101/426

[58] Field of Search ..... 101/426, 228, 181, 136, 101/138, 178, , 35, 36, 37, 118, 228, 181, 195; 400/14; 242/75.3

[56] References Cited

U.S. PATENT DOCUMENTS

| | | | |
|---|---|---|---|
| 665,016 | 1/1901 | Kershaw | 101/35 |
| 1,870,825 | 8/1932 | Sprague | 101/35 |
| 1,992,017 | 2/1935 | Spielvogel | 400/14 |
| 2,037,254 | 4/1936 | Miller | 101/35 X |
| 2,105,185 | 1/1938 | Degnan | 101/181 |
| 2,570,773 | 10/1951 | Davis | 242/75.3 |
| 2,925,035 | 2/1960 | Crawford | 101/181 |
| 3,120,181 | 2/1964 | Thiede | 101/181 |
| 3,613,679 | 10/1971 | Bijou | 128/169 |
| 3,701,315 | 10/1972 | Maund | 101/37 |
| 3,905,533 | 9/1975 | Corse | 101/228 |
| 3,995,551 | 12/1976 | Mitter | 101/118 |

FOREIGN PATENT DOCUMENTS

| | | | |
|---|---|---|---|
| 2308508 | 11/1976 | France | 101/35 |
| 269415 | 4/1927 | United Kingdom | 101/35 |
| 1370708 | 1/1972 | United Kingdom . | |
| 1285348 | 8/1972 | United Kingdom . | |
| 1339394 | 7/1975 | United Kingdom . | |
| 1513517 | 6/1978 | United Kingdom . | |

*Primary Examiner*—Richard J. Apley
*Assistant Examiner*—David J. Isabella
*Attorney, Agent, or Firm*—Powell L. Sprunger

[57] ABSTRACT

A device for applying indicia in a first geometric form to an elongated elastic web comprising, a device for longitudinally stretching the elastic web, and a device for printing the first geometric form onto a surface of the web in the stretched configuration such that the first geometric form assumes a second geometric form when the web is relaxed.

1 Claim, 3 Drawing Figures

Fig. 1
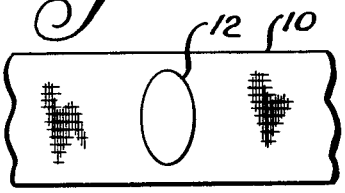
Fig. 2
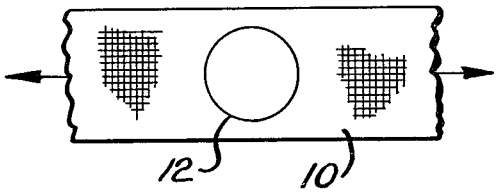
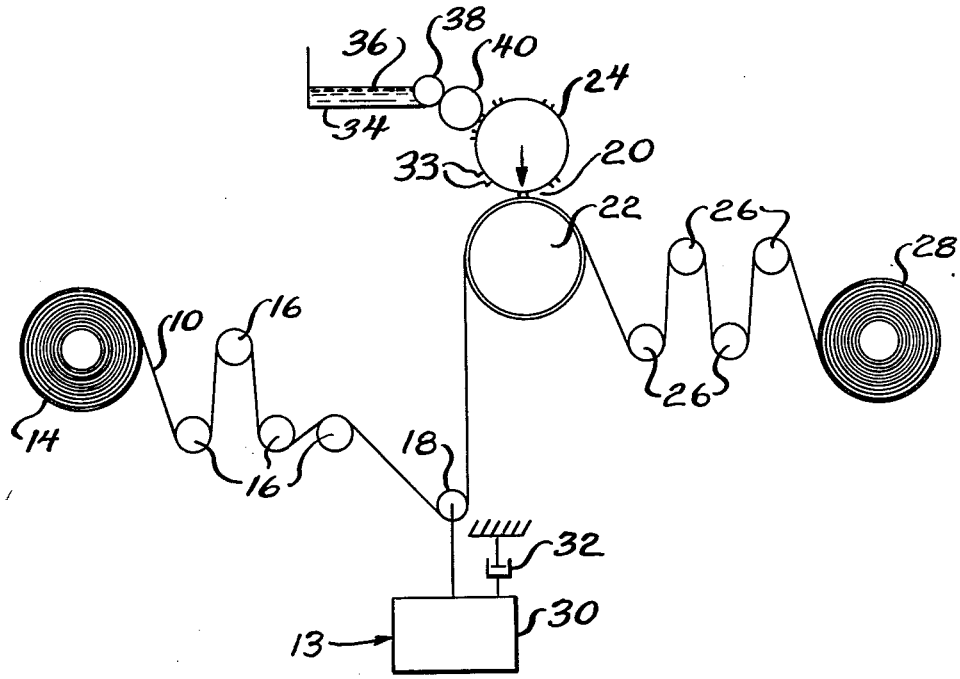
Fig. 3

DEVICE FOR APPLYING INDICIA TO AN ELASTIC WEB

BACKGROUND OF THE INVENTION

The present invention relates to devices for marking elastic bandages.

An elastic bandage is disclosed in U.S. Pat. No. 3,613,679, incorporated herein by reference. The bandage has printed indicia in a geometric form, such that the form changes to another geometric form when the bandage is placed under a tension which is assumed to indicate the desired amount of tension for wrapping a patient with the bandage. However, different lots of bandages may have differing stretch characteristics, and the tension indicated by the changed geometric form will not be uniform for the differing bandages. As a result, varying pressures will be applied to the patient by the differing bandages when the changed geometric figure is utilized to determine the wrapping tension of the bandage.

SUMMARY OF THE INVENTION

A principal feature of the present invention is the provision of a device for applying indicia in a first geometric form to an elongated elastic web.

The device of the invention comprises, means for longitudinally stretching the elastic web, and means for printing the first geometric form onto a surface of the web in the stretched configuration.

A feature of the present invention is that the first geometric form assumes a second geometric form when the web is relaxed from the device.

Another feature of the invention is that the webs printed in this manner will assume a uniform tension when stretched to obtain the first geometric form.

Thus, a feature of the present invention is that the elastic webs may be utilized as an elastic bandage to wrap a patient under uniform tension and pressure.

Further features will become more fully apparent in the following description of the embodiments of this invention and from the appended claims.

DESCRIPTION OF THE DRAWINGS

In The Drawings

FIG. 1 is a fragmentary front plan view of an elastic web with indicia in a geometric form;

FIG. 2 is a fragmentary front plan view of the web of FIG. 1 with the web stretched to obtain a changed geometric form for the indicia; and FIG. 3 is a diagrammatic view of a device for applying indicia in a first geometric form to an elongated elastic web.

DESCRIPTION OF THE PREFERRED EMBODIMENTS

Referring now to FIG. 1, there is shown an elastic web 10 comprising a bandage generally of the type disclosed in U.S. Pat. No. 3,613,679. The web 10 has printed indicia 12, such as an ellipse, in the relaxed state of the web 10. With reference to FIG. 2, when the web 10 is stretched to place the web 10 under tension, the indicia 12 changes to a different geometric form, such as a circle, as shown. In theory, the changed geometric form for the indicia 12 should indicate a desired amount of tension to be applied to the bandage when wrapping on a patient. However, the webs 10 may have different stretch characteristics between different lots or different types of webs 10, and the changed geometric form will not indicate a uniform tension when the webs are stretched to obtain the changed geometric form.

A device 13 to correct this deficiency in the web 10 is illustrated in FIG. 3. As shown, the elastic web 10 is removed from a rotatable feed roll 14 containing a supply of unprinted elastic web. The web 10 passes from the feed roll 14 over a plurality of rotatable rolls 16 to a floating rotatable roll 18 which is permitted to move in a vertical direction. The web 10 then passes from the floating roll 18 to the nip 20 between a rotatable retaining roll 22 and a rotatable print roll 24. From the nip 20, the web 10 passes over a plurality of rotatable rolls 26 to a location where it is wound onto roll 28 for subsequent handling and use. The roll 28 may be driven in order to pull the web 10 through the device 13.

The roll 22 may be free-turning, and may be made of a suitable material, such as rubber, to provide high friction characteristics for the surface of the roll 22. As shown, a weight 30 of a predetermined amount is applied to the floating roll 18 in order to bias the floating roll 18 in a downward direction relative to the retaining roll 22. In a preferred form, the floating roll 18 is located such that the web 10 passes vertically from beneath the roll 18 to the roll 22. Due to the suspended weight 30, the biased floating roll 18 causes the web 10 to stretch between the last of rolls 16 and the high friction retaining roll 22, such that the web 10 is placed under a predetermined amount of tension in the nip 20 between the rolls 22 and 24. A dash pot 32 may be connected to the weight 30, as shown, or the floating roll 18 in order to dampen movement of the weight 30 and floating roll 18. The web 10 is permitted to relax after it passes from the nip 20 such that the web 10 is in a relaxed condition when wound onto the roll 28.

The print roll 24 has raised portions 33 for printing indicia in a first geometric form onto the stretched web 10 as it passes through the nip 20 between the rolls 22 and 24. The device has an ink well 34 with a supply 36 of ink which is exposed to a first rotatable ink roll 38. The ink roll 38 is in contact with a second rotating ink roll 40 which in turn is in contact with the print roll 24. The first ink roll 38 removes ink from the well 34, and transfers the ink to the second ink roll 40 which in turn transfers the ink onto the raised indicia 33 of the print roll 24. In turn, the print roll 24 transfers the ink from the raised indicia 33 onto a face of the elastic web 10.

Thus, the print roll 24 prints the indicia in a first geometric form, such as the circle of FIG. 2, onto the web 10 which is stretched under a desired tension as determined by the weight 30. When the web 10 is relaxed, the printed indicia assumes a second geometric form of longitudinally reduced dimension, such as the ellipse of FIG. 1. Since the webs 10 are printed in the stretched configuration under a predetermined tension, the various webs 10 printed in this manner will stretch to a uniform tension when wrapped to obtain the changed geometric form, e.g., the circle of FIG. 2, with the uniform tension being the tension under which the webs are printed in the stretched configuration by the print roll 24. Accordingly, the webs 10 may be utilized as an elastic bandage for wrapping a patient under uniform tension and pressure. As a specific example, in the relaxed configuration of the web 10 the indicia will appear as the ellipse 12 in FIG. 1. When the bandage is stretched to wrap the patient the changed geometric form of the circle illustrated in FIG. 2 will indicate proper wrapping tension to obtain the predetermined pressure. As previously discussed, since the geometric form of FIG. 2 is printed in the stretched configuration of the web 10, the bandage will result in uniform wrapping pressues to the patient even though the bandages may vary from lot to lot in having different stretch characteristics.

The foregoing detailed description is given for clearness of understanding only, and no unnecessary limitations should be understood therefrom, as modifications will be obvious to those skilled in the art.

I claim:

1. A method of determining the amount of tension in an elastic web, by applying indicia in a first, repetitive, geometric form along the lengths of elastic webs stretched into an elongated shape, such that in stretching use of the webs after printing, said indicia in said first form represent a predetermined amount of tension being applied to the webs regardless of the degree of stretch variation of different webs when each is stretched to attain said predetermined amount of tension, comprising the steps of:

predetermining the amount of tension the indicia in said first form will indicate after printing;

longitudinally stretching an elastic web to said predetermined amount of tension, irrespective of the length of stretch required to be imparted to the web to attain said predetermined amount of tension by suspending the web between a feed means and a retaining roll, the retaining roll having high friction characteristics on the outer surface thereof, the elastic web being formed into a loop between the feed means and the retaining roll;

maintaining said predetermined amount of tension in the web completely and entirely independently of elongation in the web, or variations in the elongation of the web, or speed of travel of the web from the feed means over the retaining roll, or rotational speed of the retaining roll, consisting solely of the steps of locating a floating roll on the loop, applying a downward bias to the floating roll equal to said predetermined amount of tension by attaching a weight to the floating roll, and dampening the floating roll to mitigate fluctuations in the floating roll caused by passage of the elastic web loop around the floating roll, whereby a portion of the web on the retaining roll having high friction characteristics is stretched to a degree equaling said predetermined degree of tension regardless of the degree of elongation imparted to the web to attain the degree of stretch equaling said predetermined degree of tension; and printing said indicia in said first geometric form while the web is stretch to said predetermined amount of tension by passing the web through a nip defined by the retaining roll and a print roll and while the web is stretched as aforesaid on the retaining roll, said indicia, after the web is relaxed and allowed to return to an unstretched condition, assuming a second geometric form which is other than said first geometric form, said first and second geometric forms, when compared, being readily visually perceived as being different.

* * * * *